United States Patent [19]

Elkins

[11] 4,019,502

[45] Apr. 26, 1977

[54] HYDROTHERAPY DEVICES

[75] Inventor: Christopher W. Elkins, Fort Collins, Colo.

[73] Assignee: Teledyne Water Pik, Fort Collins, Colo.

[22] Filed: Mar. 22, 1976

[21] Appl. No.: 669,283

[52] U.S. Cl. ..... 128/65; 128/25 B

[51] Int. Cl.[2] ..... A61H 9/00

[58] Field of Search ..... 128/65, 66, 25 B, 32, 128/33–36

[56] References Cited

UNITED STATES PATENTS

| | | | |
|---|---|---|---|
| 2,904,037 | 9/1959 | Cassidy | 128/66 |
| 3,830,232 | 8/1974 | McNair | 128/25 B |

*Primary Examiner*—Lawrence W. Trapp
*Attorney, Agent, or Firm*—Hugh H. Drake

[57] ABSTRACT

A hydrotherapy device takes the form of a generally tub-shaped lower housing having an upper rim. A generally tub-shaped upper housing of resilient material is nested within the lower housing and has a periphery matable with the rim of the lower housing. The bottom wall of the upper housing is spaced from the bottom wall of the lower housing when the housings are nested together. The rim is secured to the periphery as the only support of the upper housing. A vibratory apparatus is secured to a wall of the upper housing and disposed between the respective walls of those housings.

14 Claims, 19 Drawing Figures

HYDROTHERAPY DEVICES

The present invention pertains to hydrotherapy devices. More particularly, it relates to devices that apply a massage-type effect to human extremities placed within the apparatus.

Footbaths are known in which an extremity, such as a foot, is immersed in water. In some versions, the water is agitated by some kind of underlying or otherwise associated vibratory transducer; in other versions, a whirlpool action has been induced in the water. Various mechanical approaches to the achievement of massage action in general have involved the use of either eccentrically-weighted rotary motors for imparting the vibratory action or electro-mechanical linear-type actuators. For some reason, the prior footbaths have not seemed to have "caught-on" in the marketplace for domestic usage.

It is, accordingly, a general object of the present invention to provide a new and improved hydrotherapy device which is more attractive to the desires of potential domestic users.

Another object of the present invention is to provide such a hydrotherapy device which is readily manufactured by normal manufacturing techniques, so as to result in ultimate cost effectiveness.

A further object of the present invention is to provide a hydrotherapy device which is highly effective while yet capable of being manufactured in an economical manner when considered in the light of its advantageous results.

Still another object of the present invention is to provide a massage device which yields improved performance.

Such a hydrotherapy device includes a generally tub-shaped lower housing that has an upper rim. A generally tub-shaped upper housing is formed of resilient material and shaped so as to be nested within the lower housing. The upper housing has a periphery that is matable with the rim, the bottom wall of the upper housing being spaced from the bottom wall of the lower housing when the housings are nested together. The rim is secured to the periphery in a manner such that the rim is the only support of the upper housing. Finally, vibratory means are secured to a wall of the upper housing and disposed between the respective walls of the two housings.

Desirably, the bottom wall of the upper housing is slanted in one direction, the unit includes a weighted impeller on an electric motor for creating the vibration, the supports for such a vibratory means are so distributed as to result in a variation in vibratory action within water contained in the upper housing, provision is made for locking the two housings together during transportation of the overall device, all electrical means are protected by water-impervious material and the electrical supply is so introduced as to preclude damage to the remainder of the unit upon undue tension in that supply.

The features of the present invention which are believed to be novel are set forth with particularity in the appended claims.

The organization and manner of operation of the invention, together with further objects and advantages thereof, may best be understood by reference to the following description taken in connection with the accompanying drawings, in the several figures of which like reference numerals identify like elements, and in which.

Figure 1:
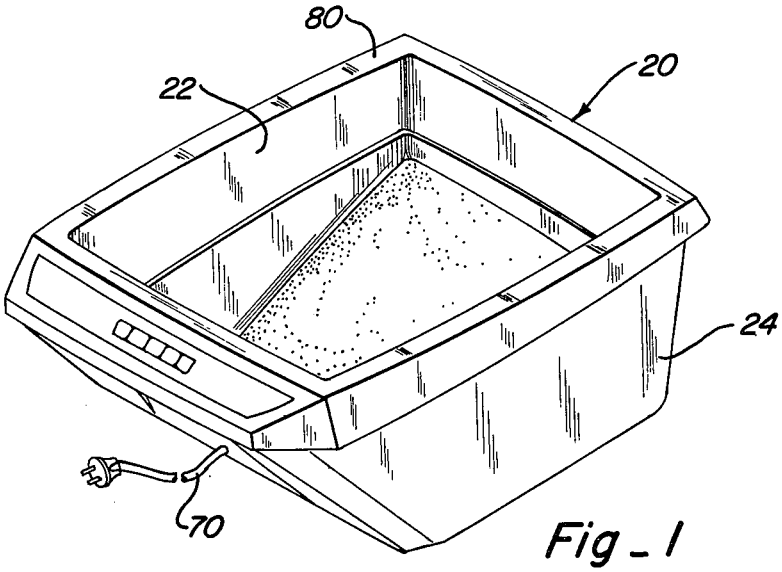
FIG. 1 is a perspective view of a hydrotherapy device.
Figure 2:
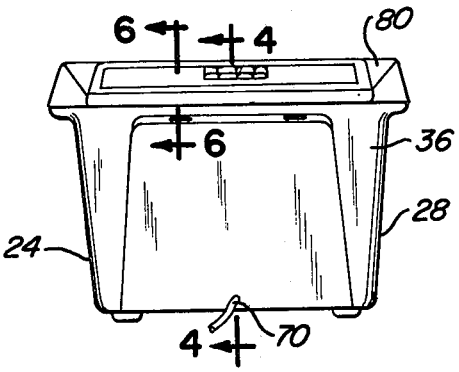
FIG. 2 is a left-end elevational view of the device of FIG. 1.
Figure 3:
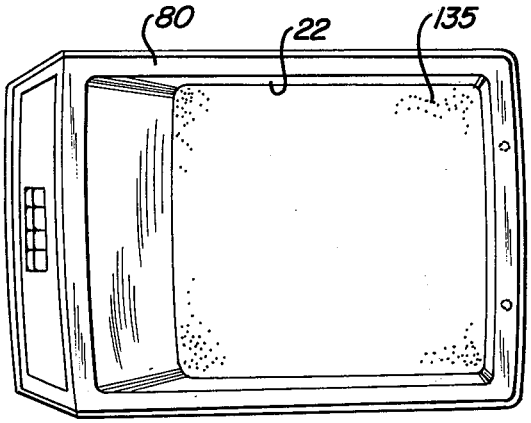
FIG. 3 is a top plan view of the device of FIG. 1.
Figure 4:
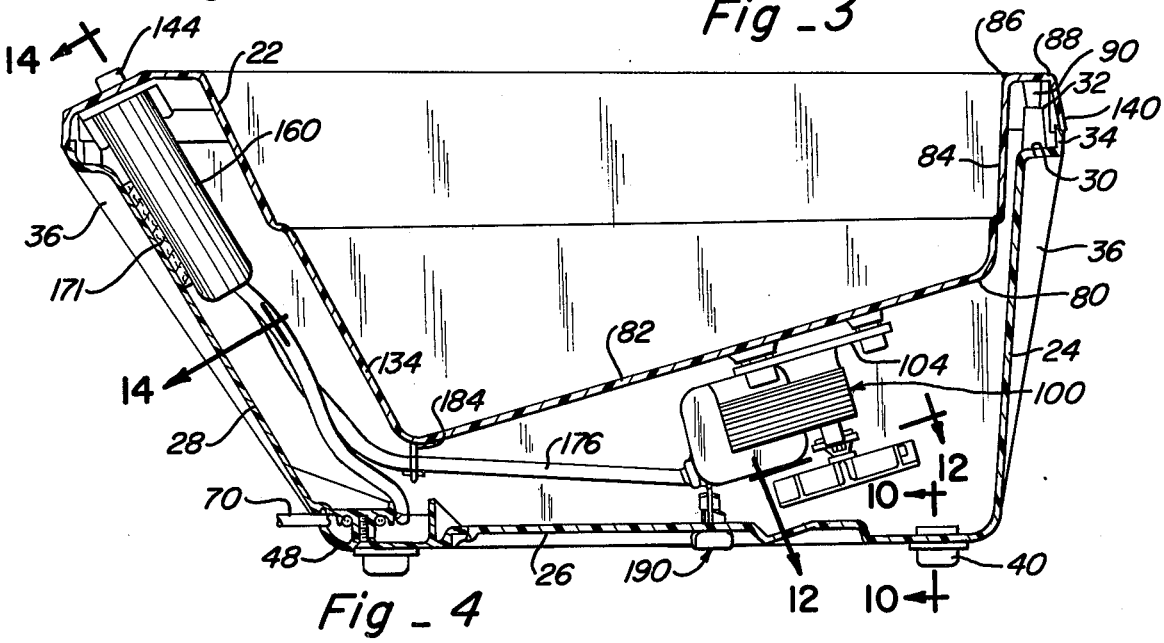
FIG. 4 is a cross-sectional view taken along the line 4—4 in FIG. 2.
Figure 5:
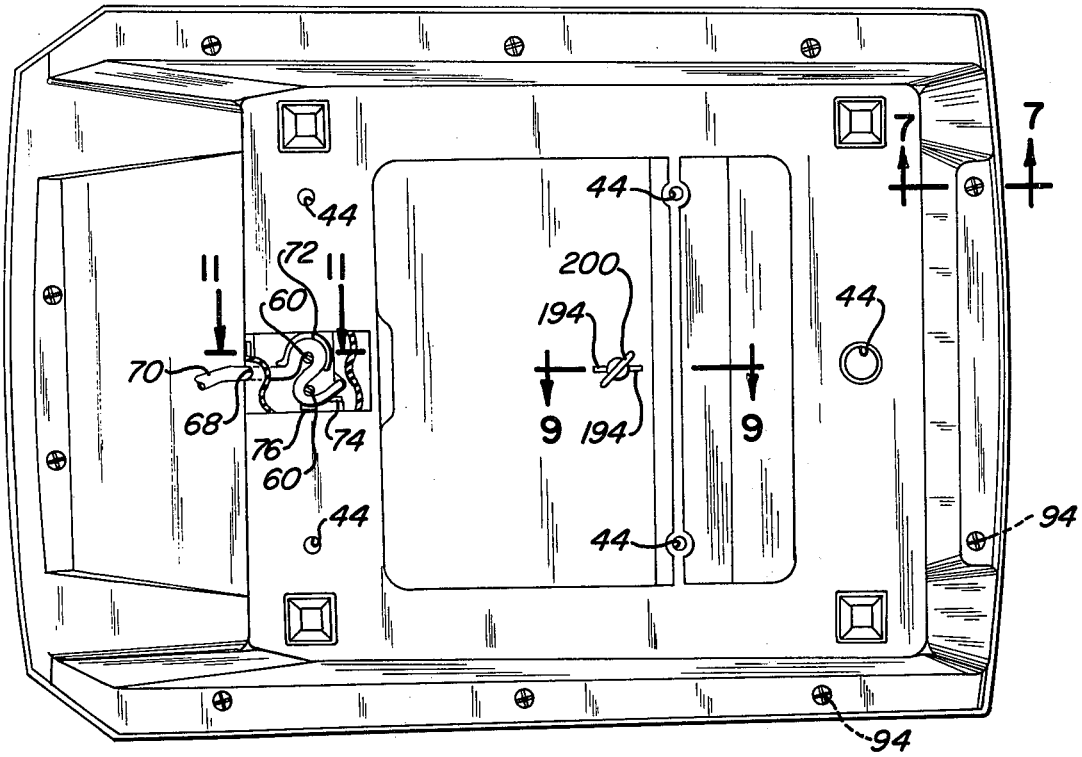
FIG. 5 is an enlarged bottom plan view, partially broken away, of the device of FIG. 1.
Figure 11:
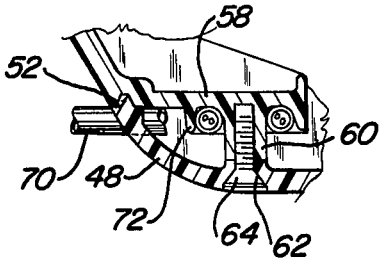
FIG. 11 is an enlarged fragmentary cross-sectional view taken along the line 11—11 in FIG. 5.
Figure 12:
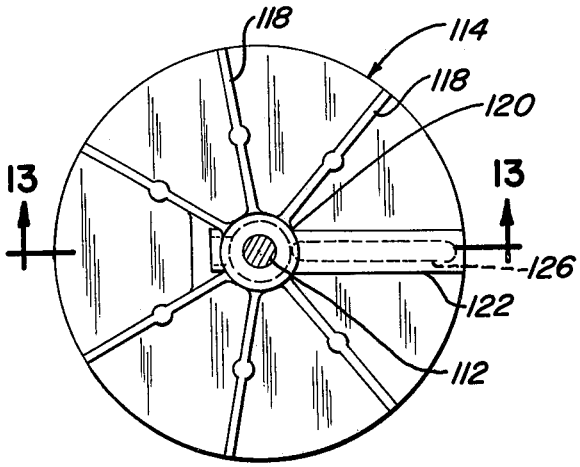
FIG. 12 is an enlarged fragmentary cross-sectional view taken along the line 12—12 in FIG. 4.
Figure 13:
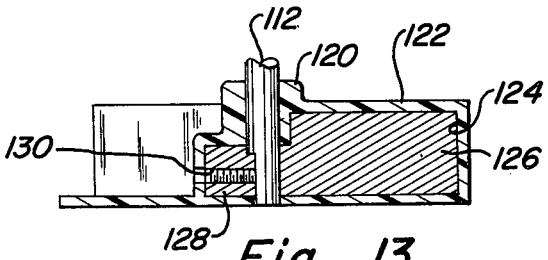
FIG. 13 is a cross-sectional view taken along the line 13—13 in FIG. 12.

A hydrotherapy device 20 is of a size to accept at least one and preferably both feet of a user. Thus, it also is of a size sufficiently large to accept a different extremity such as a hand, forearm or elbow. Device 20 includes a cavity 22 which, in the use of the device, may or may not be filled with water or other liquid, depending upon the user's desires.

In more detail, a generally tub-shaped lower housing 24 has a bottom wall 26 and a continuous sidewll 28. Projecting outwardly from the upper rim 30 of sidewall 28 are a succession of bosses 31 that together define a series of shelves 32. Spaced outwardly from bosses 31 and continuing around the region of rim 30 in an upwardly-projecting wall portion 34. Generally vertically disposed fluting 36 integrally formed along each of the four corners of sidewall 28 serves both as a wall-reinforcing rib and also lends attractiveness to the overall appearance. Frictionally received within a plurality of openings 38 are respective rubber feet 40 captivated in openings 38 by space-opposed grooves. Several openings 44 in the lowest portions of bottom wall 26 serve to permit drainage of any moisture which may collect on the upper surface of bottom wall 26 by condensation or otherwise.

Centrally located near one end portion of bottom wall 26 is an opening 46. A strain relief 48 is shaped to form continuation of bottom wall 26 throughout opening 46 and into its merger with sidewall 28. Relief 48 has shoulder formations 50 and 52 around its periphery to mate with corresponding offsets 54 and 56 in the rim of opening 46.

Projecting inwardly from the lower end of sidewall 28 at opening 46 is a flange 58. Projecting downwardly from flange 58 are a spaced pair of posts 60 each of which mates with an opening 62 in strain relief 48 so that screws 64 may be inserted through openings 62 and threaded into respective internal bores formed in posts 60 thereby to secure strain relief 48 in place. Another opening 68 in strain relief 48 receives a multi-conductor, insulated, flexible power-supply input cable 70. A semi-circular wall 72 and a pair of spaced lugs 74 and 76 all depend downwardly from flange 58 and are so located and positioned as to cooperate with posts 60 for the purpose of defining a figure-eight shaped channel in which cable 70 is frictionally captivated, thereby preventing the cable from being pulled outwardly or pushed in through opening 68. While a variety of materials could be used in the formation of lower housing 24 and strain relief 48, both preferably are molded from a plastic that presents hard and durable surfaces but yet which retains a degree of lateral flexibility sufficient to afford reliency. A suitable such material is A.B.S. Marbon Cycololac D.F.A.

A likewise generally tub-shaped upper housing 80 defines cavity 22 and is nested within lower housing 24 with its bottom wall 82 spaced above bottom wall 26 and which has a continuous sidewall 84 spaced from sidewall 28. Projecting outwardly from the upper periphery 86 of upper housing 80 is a ledge 88 spaced above shelves or shelf portions 32 by a series of posts 90 which depend downwardly from ledge 88 and are distributed in spaced-apart relationship successively around ledge 88 so as to be in alignment with respective ones of bosses 31. A plurality of respective openings 92 in bosses 31 are aligned with bores in corresponding ones of posts 90 so as to receive screws 94 that serve to secure and fasten upper rim 30 to upper periphery 86. Moreover, that securing means, including ledge 88 carried upon shelves 32 by posts 90, serves as the only support of upper housing 80 upon lower housing 24. Upper housing 80 again is preferably formed of a moldable plastic that presents a durable and relatively hard surface but yet which exhibits sufficiently resiliency as to impart lateral flexibility to its walls (or vice versa). Posts 90 and bosses 31 together serve as a series of spaced uprights that secure periphery 86 to rim 30.

By reason of such flexibility in combination with the manner of sole support around its upper periphery, the walls of upper housing 80 may be caused to impart vibration. A variety of apparatus is known for imparting vibratory motion to a surface. These include mechanical relay-type devices, in which an armature vibrates laterally about a pivot thereof, eccentrically-weighted rotationally-operative devices and solid state units such as piezoelectric driving components. In a presently preferred embodiment, an electric motor 100 has an eccentrically weighted rotor. Motor 100 has its standard laminations 102 directly secured to a bracket 104. Formed into bracket 104 are three wells 106 spaced apart in a triangular relationship. Depending downwardly from the generally-central region of the underside of bottom wall 82 are a like plurality of three triangularly-distributed posts 108 so aligned as to be received within the respective ones of wells 106. Screws 110 are inserted through openings in the bottoms of wells 106 and threaded into respective central bores formed in posts 108.

Motor 100 includes a rotor 112 carried by a bearing 113. Upon the generally lower end of rotor 112 is mounted a impeller 114. Impeller 114 includes a plate 116 disposed transversely to rotor 112 and from which project, in a spoke-like manner, a plurality of radially-aligned ribs 118. Ribs 118 terminate at their inward ends in a hub 120 which serves to mount impeller 114 upon the lower end portion of the shaft of rotor 112. When impeller 114 is rotated by motor 100, ribs or blades 118 function as a centrifugal fan to circulate air within the space between lower walls 26 and 82. Such circulating air tends to keep that interior compartment dry by assisting in the evaporation of any moisture that might condense or otherwise be formed on any of the interior surfaces of the compartment, and it also assists in the cooling of motor 100.

Also formed during the molding of impeller 114 is a radially-extending and, thus again like a spoke, elongated housing 122 the interior of which defines a compartment 124 in which a weight 126 is captivated during the molding of the impeller. The interior end portion of weight 126 is necked-down as illustrated so as also to seat upon the rotor shaft as a hub 128. A radially-extending bore 130 is internally threaded so as to receive a set-screw for the purpose of locking the entire assembly of impeller 114 upon that rotor shaft. Preferably, impeller 114 is molded from a nylon material such as DuPont Zytel 101 Natural. Weight 126 illustratively is formed from die-cast zinc metal.

Preferably, bottom wall 82 is so oriented as to slant downwardly toward one end of cavity 22. At the same time, the portion 134 of sidewall 84 adjacent to the deeper end of cavity 22 is formed so as to exhibit a substantial outward tilt as shown. Both the downward slant of bottom wall 82 and the outward tilt of sidewall portion 134 serve to enable the user to place the bottoms of his feet more comfortably when sitting on an adjacent chair or the like. In addition, it appears that the downward slant of bottom wall 82, from which motor 100 is suspended, enables the eccentrically-developed forces produced upon the rotation of weight 126 to enhance the effectiveness of the transmission of vibration into cavity 22 through flexure of bottom wall 82.

Desirably, the upper surface 135 of bottom wall 82 is textured or roughened slightly so as to provide better frictional engagement between the sole of the user's feet and the bottom wall 82 during use. That better frictional engagement seems also to augment the transmission of vibration as actually felt by the user.

Of course, when motor 100 is energized so as to spin weight 126 eccentrically, vibrational movement is imparted through bottom wall 82. Moreover, the mode of that vibration, and to some degree the direction of its transmission, frequently changes in what appears to be a somewhat random manner. Both by visual observation and also by using the sense of feel as in the fingertips, the regions at and surrounding a certain two of posts 108 exhibit a high amplitude of vibration while the region at and surrounding the remaining one of posts 108 exhibits at least very minimal amplitude of vibration. Subsequently, without making any externally controllable change, the pattern switches rather suddenly, and it will be observed that a different pair of the regions at and surrounding the respective posts exhibit the high-amplitude of vibration. This switching of maximum vibration areas as between each of the different possible pairs of the respective regions continues throughout the operating interval and appears to occur at random differences in time and without any predetermined sequence. Such vibration-mode switching also is observable when cavity 22 is a least partially filled with water. The vibration pattern at the surface of the water similarly undergoes different changes, indicating corresponding changes in either mode or direction of vibration transmitted through the water. These changes are believed to contribute to the effectiveness of the massaging action achieved through use of the device.

Figure 6:
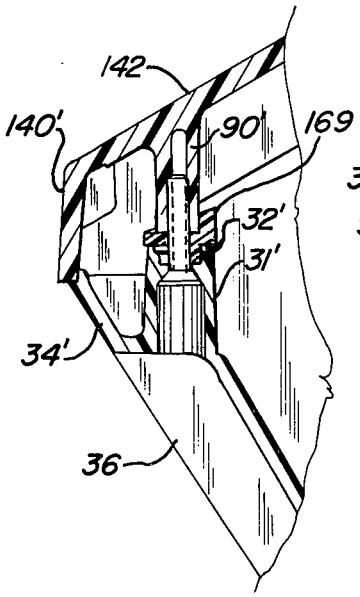
FIG. 6 is a fragmentary cross-sectional view taken along the line 6—6 in FIG. 2.
Figure 7:
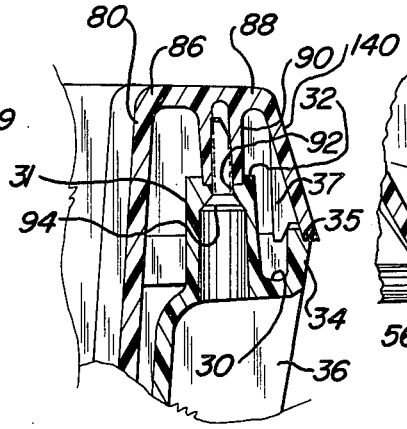
FIG. 7 is a fragmentary cross-sectional view taken along the line 7—7 in FIG. 5.
Figure 8:
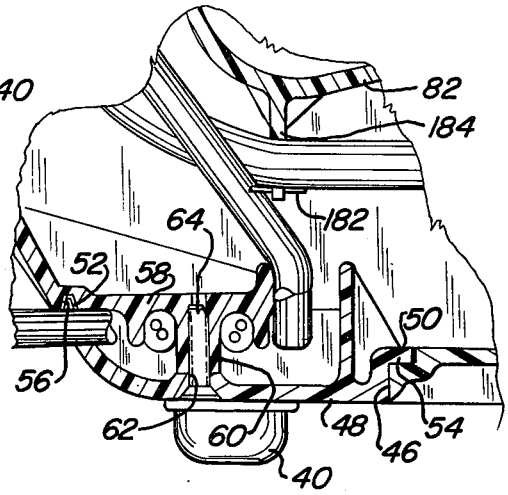
FIG. 8 is a fragmentary enlargement of the lower left-hand portion of FIG. 4.
Figure 9:
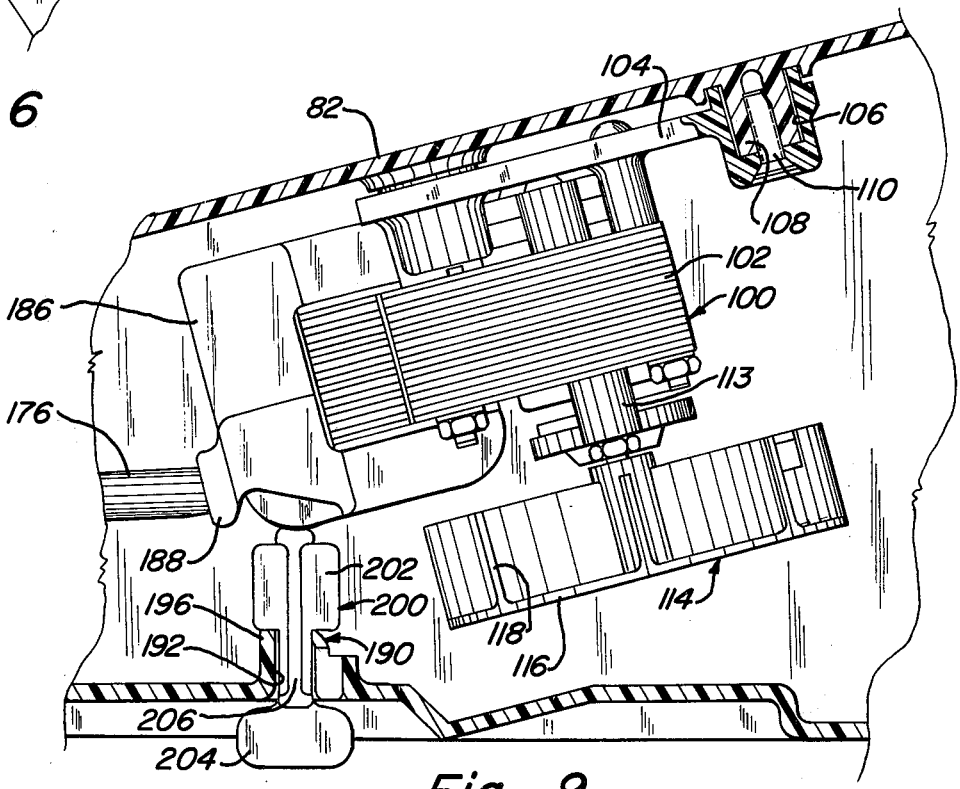
FIG. 9 is an enlarged fragmentary cross-sectional view taken along the line 9—9 in FIG. 5.
Figure 10:
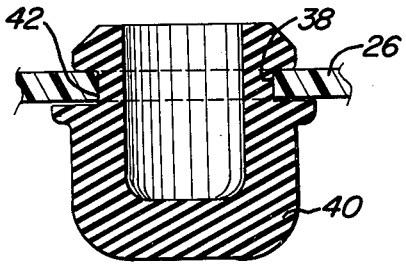
FIG. 10 is an enlarged fragmentary cross-sectional view taken along the line 10—10 in FIG. 4.
Figures 14, 15, 16, 17:
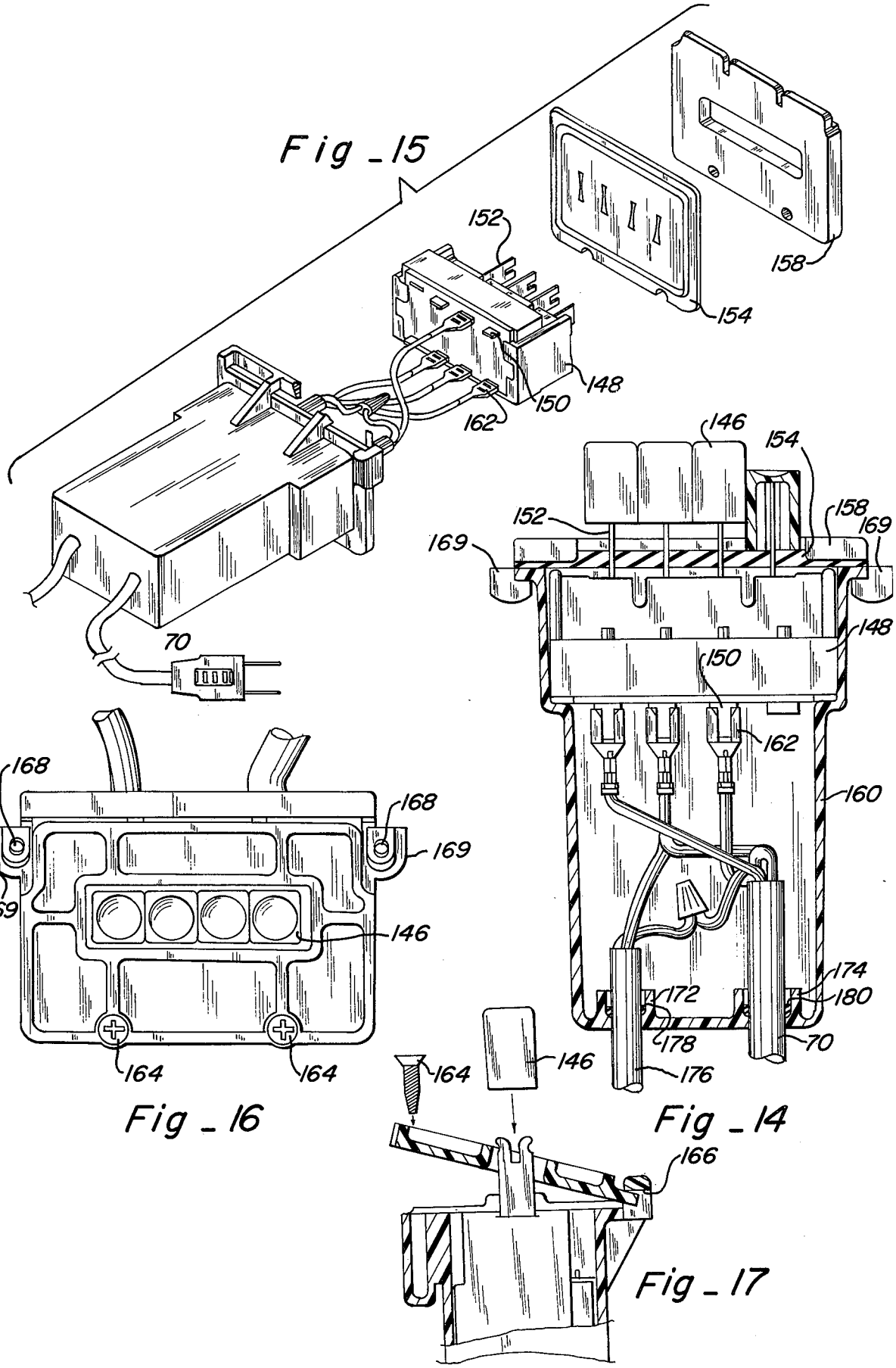
FIG. 14 is an enlarged fragmentary cross-sectional view taken along the line 14—14 in FIG. 4.
FIG. 15 is an exploded perspective view of various components shown in FIG. 14.
FIG. 16 is a top plan view of the assembly of FIG. 14.
FIG. 17 is a right-end elevational view of the assembly of FIG. 14, being partially broken away and modified to indicate manner of assembly.
Figure 18:
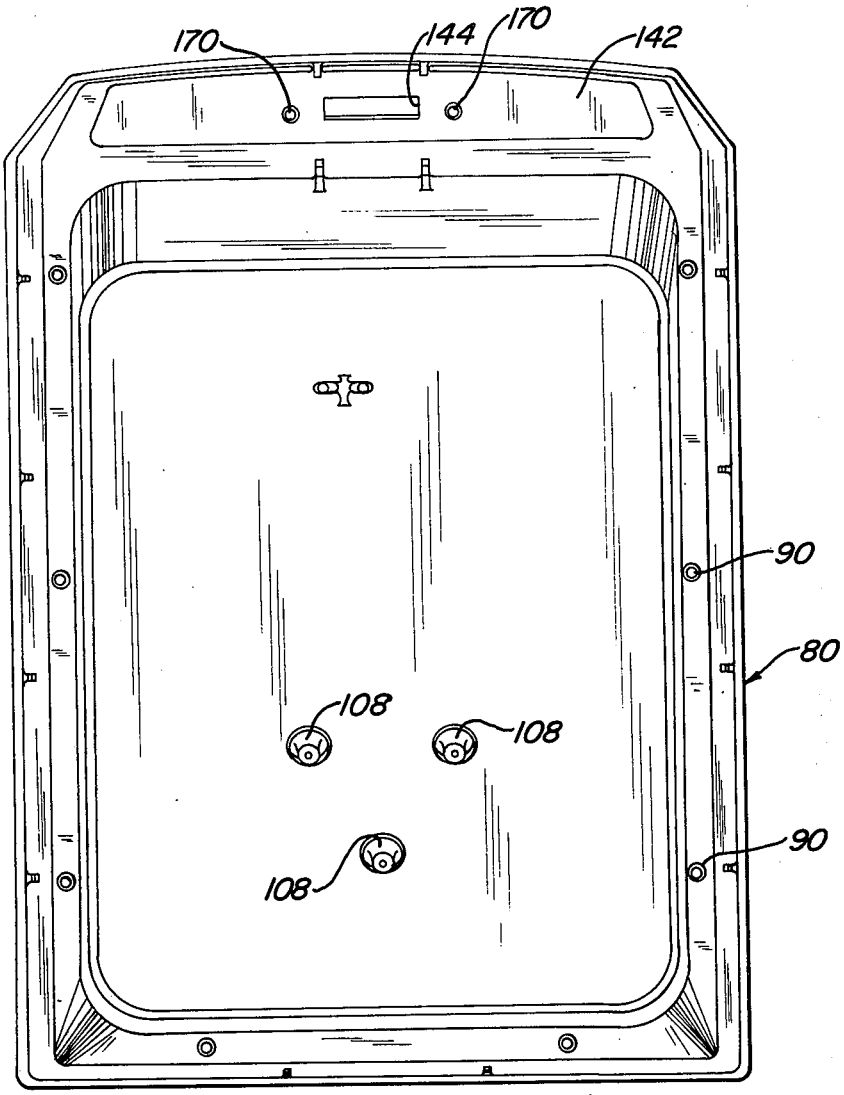
FIG. 18 is a bottom plan view of a portion of the assembly shown in FIG. 4.
Figure 19:
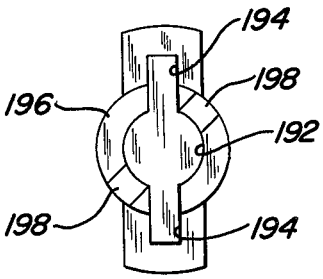
FIG. 19 is a top plan view of a component detail shown primarily in FIG. 9.

Projecting downwardly from ledge 88, and slanting slightly outwardly, is a skirt 140 which mates at its lower edge with a recess 35 formed at the upper outer margin of wall portion 34. A series of peripherally-spaced lugs 37, projecting inwardly and downwardly from skirt 140, engage the upper interior margin of wall portion 34. Around the two longitudinal sides and the shallower end of cavity 22, skirt 140 and wall portion 34 are of generally constant shape. Along the upper peripheral region which extends across the deeper end of cavity 22, however, and as best can be seen in FIG. 6, the shapes of wall portion 34' and skirt portion 140' are slightly modified by reason of the additional outward tilt of the housing sidewalls at that end of cavity 22 and also so as to accomodate the included formation of a switch panel 142. Posts 90' and bosses 31' also are appropriately modified.

An opening 144 is centrally disposed in panel 142 through which a plurality of pushbuttons 146, in this case four, project. As embodied, pushbuttons 146 permit selection of the function of on-off and of any one of three different speeds of operation of motor 100. Pushbuttons 146 operate respective switch elements sealed within a switch housing 148 and from the rear side of which associated terminal posts 150 project. The operating shafts 152 of the respective pushbuttons project sealingly through slits in a rubber boot 154 the peripheral portion of which also serves as a sealing gasket between a switch cover 158 and a switch enclosure 160. Enclosure 160 defines a cavity in which switch housing 148 is seated, and electrical connections are made as by means of terminal lugs 162 which connect to terminal posts 150. Enclosure 160 is secured to cover 158 along one margin by a pair of screws 164 and is captivated along its opposite margin by a slot 166 formed in the upper marginal portion of enclosue 160. A pair of oppositely-disposed apertures 168 in ears 169 mate with corresponding openings 170 in posts 90', ears 169 being sandwiched between posts 90' and bosses 31'. A resilient pad 171 spaces enclosure 160 from the adjacent portion of sidewall 28 to dampen possible switch housing vibration.

Formed into the bottom wall of enclosure 160 are a pair of collars 172 and 174 surrounding respective openings through which cables 70 and 176 are received. O-rings 178 and 180 serve to seal cables 70 and 176 within collars 172 and 174. Cable 176 is led beneath the lowermost corner of cavity 22 and on into motor 100. A fastener 182 secures cable 176 to a strut 184 that projects downwardly from the middle of that lowermost corner of cavity 22.

As herein embodied, motor 100 is of the shaded-pole type. Its electrical energizing windings are wound upon a bobbin which encircles the usual bite portion of the stator laminations. Moreover, the bobbin and its included windings are entirely encapsulated within a hermetic sealing coating as indicated at 186. Cable 176 is similarly sealed at its entrance 188 into the interior of coating 186 where the wires within cable 176 terminate in respective connection to the corresponding terminals of the motor windings.

Because the entire weight of motor 100 is normally suspended from bottom wall 82 and upper housing 80 and the motor are so mounted as to be almost free floating, the possibility exists that damage to the unit may occur during shipment if it is heavily bounced. A latch assembly 190 is formed into bottom wall 26 at a location immediately beneath the bottom portion of motor 100. Mechanism 190 includes a keyway 192 and space-opposed, radially-extending slots 194 defined in an upwardly projecting stub 196. Radially aligned recesses 198 are cut into the end of stub 196. Cooperating with locking mechanisms 190 is a key 200 that has a blade 202 spaced from a handle 204 by an intermediate shaft 206. For use, handle 204 may be grasped between the thumb and forefinger and manipulated so as to cause blade 202 to pass through slots 194. The outer end of shaft 206, beyond 202, is then pressed against the surface coating 186 on the bobbin so as to press motor 100 in the upward direction and enable the turning of handle 204 so that blade 202 slips into recesses 198. Desirably the upper end surface of stub 196 tapers slightly between each of slots 194 and the adjacent one of recesses 198 so as to facilitate twisting of key 200 into its locked position. Upon completion of shipment and placement of the hydrotherapy device at its intended location, key 200 is twisted backwardly, while exerting a slight upward pressure, so as to free blade 202 from recesses 198 and permit its withdrawal through slots 194.

In use, the hydrotherapy device disclosed has been found to be very effective. Yet, it is quite economical of construction and assembly, primarily by reason of its arrangement so as to minimize the total number of components and to be able to take maximum advantage of the use of conventional molding operations to form the bulk of the different components. By forming both upper and lower housings of an insulative plastic material while at the same time entirely sealing and encapsulating all electrical components and wiring contained in the space between the two housings, double insulation is obtained throughout for maximum protection. The unit is comparatively lightweight and yet very durable. Moreover, it may be used effectively either with or without the addition of a liquid such as water within the cavity.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. A hydrotherapy device comprising:

a generally tub-shaped lower housing having an upper rim;

a generally tub-shaped upper housing of resilient material and nested within said lower housing and having an upper periphery matable with said rim, the bottom wall of said upper housing being spaced from the bottom wall of said lower housing when said housings are nested together;

means for fastening said rim to said periphery as the only support of said upper housing;

and vibratory means secured to a wall of said upper housing and disposed between the respective walls of said housings.

2. A device as defined in claim 1 in which said bottom wall of said upper housing slants in one direction relative to said rim.

3. A device as defined in claim 1 in which said vibratory means is secured to said bottom wall of said upper housing.

4. A device as defined in claim 1 in which said vibratory means includes an electric motor the rotating shaft of which is eccentrically weighted and which further includes a plurality of supports securing said vibratory means directly to said wall and mutually spaced from one another.

5. A device as defined in claim 4 in which there are three of said supports disposed in triangular relationship.

6. A device as defined in claim 1 which further includes manually removable means for locking said housings together and thereby restricting relative movement of the walls of said housings and of said vibratory means.

7. A device as defined in claim 1 in which said periphery includes a flange and in which switch means, for controlling operation of said vibratory means, are mounted in said flange.

8. A device as defined in claim 7 in which said switch means are ensealed by a water-impervious material.

9. A device as defined in claim 1 which further includes:

a multi-conductor electric cable for supplying power to said vibratory means;

a removable segment of said lower housing having an opening admitting said cable;

means secured to said segment for captivating said cable;

and means for securing said segment in said opening with said segment serving to release strain in said lower housing exerted by tension in said cable.

10. A device as defined in claim 1 in which said rim has an upwardly-projecting peripheral wall portion disposed outwardly of said securing means, and in which said periphery has a downwardly-depending skirt sealingly engageable with said wall portion.

11. A device as defined in claim 10 which further includes a series of lugs, spaced around and projecting from one of said wall portion and skirt, for engaging said wall portion with said skirt.

12. A device as defined in claim 1 in which said periphery includes an outwardly-projecting ledge, in which said rim includes outwardly-projecting shelf portions spaced beneath said ledge and in which said fastening means includes a series of uprights supporting said ledge on said shelf portions and spaced apart successively around said periphery and rim.

13. A device as defined in claim 12 in which said uprights include a series of posts and bosses projecting respectively from said periphery and said rim.

14. A device as defined in claim 1 which includes means for selectively varying the frequency of vibration produced by said vibratory means, such variation in frequency also varying the amplitude of the vibrations.

* * * * *